US007070521B2

(12) United States Patent
Bayduke

(10) Patent No.: US 7,070,521 B2
(45) Date of Patent: Jul. 4, 2006

(54) FOOTBALL TRAINING DEVICE

(76) Inventor: Ronald L. Bayduke, 181 Porter Dr., Akron, OH (US) 44319-4428

( * ) Notice: Subject to any disclaimer, the term of this patent is extended or adjusted under 35 U.S.C. 154(b) by 0 days.

(21) Appl. No.: 10/831,256

(22) Filed: Apr. 23, 2004

(65) Prior Publication Data

US 2005/0239580 A1 Oct. 27, 2005

(51) Int. Cl.
*A63B 69/34* (2006.01)

(52) U.S. Cl. ..... 473/438; 473/441; 473/445

(58) Field of Classification Search ..... 473/438–445, 473/470, 422

See application file for complete search history.

(56) References Cited

U.S. PATENT DOCUMENTS

| | | | | | |
|---|---|---|---|---|---|
| 1,176,730 | A | * | 3/1916 | Ashton | 473/443 |
| 2,234,364 | A | * | 3/1941 | Carberry | 473/443 |
| 2,696,383 | A | * | 12/1954 | Noftsinger | 473/441 |
| 2,934,854 | A | * | 5/1960 | Comfort, Sr. | 446/286 |
| 3,046,695 | A | * | 7/1962 | Henrickson et al. | 446/287 |
| 3,390,880 | A | * | 7/1968 | Forrest | 473/441 |
| 3,391,936 | A | * | 7/1968 | Grimes | 473/439 |
| 3,573,867 | A | * | 4/1971 | Mehrens | 473/439 |
| 3,675,921 | A | | 7/1972 | Meyer, Sr. | |
| 3,698,125 | A | * | 10/1972 | Hartling et al. | 446/288 |
| 3,754,351 | A | * | 8/1973 | Glass et al. | 446/338 |
| 3,810,618 | A | | 5/1974 | Nedwick | |
| 3,834,071 | A | * | 9/1974 | Terzian et al. | 446/353 |
| 4,186,922 | A | * | 2/1980 | Ketchum | 473/443 |
| 4,545,775 | A | * | 10/1985 | Kim | 446/299 |
| 4,688,792 | A | * | 8/1987 | Rivkin | 482/90 |
| D321,370 | S | * | 11/1991 | Curtis | D19/62 |
| 5,160,138 | A | | 11/1992 | Sanders | |
| 5,252,076 | A | | 10/1993 | Kelleher | |
| 5,527,185 | A | | 6/1996 | Davis | |
| 5,800,291 | A | * | 9/1998 | Grover | 473/447 |
| 5,816,951 | A | | 10/1998 | Hudock | |
| 6,261,195 | B1 | * | 7/2001 | Shingleton | 473/442 |
| 6,599,206 | B1 | * | 7/2003 | Forrest et al. | 473/441 |
| 6,679,795 | B1 | | 1/2004 | Ouimette et al. | |
| 6,685,581 | B1 | * | 2/2004 | Krause et al. | 473/445 |
| 6,866,595 | B1 | * | 3/2005 | Elder et al. | 473/446 |

* cited by examiner

*Primary Examiner*—Mitra Aryanpour
(74) *Attorney, Agent, or Firm*—Hudak, Shunk & Farine Co. LPA

(57) ABSTRACT

A device which is utilized during practice or other informal situation to teach a football player such as a quarterback or kicker to deliver a football around or over one or preferably a group of linemen. In one embodiment, the device includes a mechanism capable of moving at least one figure, simulative of a human athlete, from an inactive position to an active position which is adapted to mimic predetermined characteristics of a defensive line.

28 Claims, 5 Drawing Sheets

FOOTBALL TRAINING DEVICE

FIELD OF THE INVENTION

The present invention relates to a football skills training device which is utilized during practice or other informal situation to teach a football player such as a quarterback or kicker how to deliver a football around or over at least one and preferably a group of defensive linemen. In one embodiment, the device includes two or more figures, each simulative of a human athlete which are each operatively connected to and height adjustable on a base. In a further embodiment, the training device includes a mechanism capable of moving at least one figure from an inactive position to an active position which is adapted to mimic predetermined characteristics of a defensive line.

BACKGROUND OF THE INVENTION

The game of football requires coordination between mental and physical skills. In order to improve these skills, players are subjected to numerous practice sessions generally in a formalized setting in order to learn new or different techniques or procedures.

It is often desirable for a quarterback or kicker to practice against a scout team having a defensive line which mimics an upcoming opponent in order to become better prepared or accustomed to what is likely to happen in a real game situation. Often times players will be injured during the noted practice sessions. For obvious reasons, it would be desirable to prevent injuries to team players during practice.

Furthermore, often times it is not possible to assemble a scout team which has the same height and width characteristics for a player in each position in order to simulate the upcoming opponent. It would be desirable for a football player, especially a quarterback or kicker to practice against the best "look" of an opponent, utilizing the same formation, as well as having the same or similar height and width dimensions of the opponent.

U.S. Pat. No. 3,810,618 relates to an apparatus for developing skill in playing football, the device consisting of a target game unit and a training unit which are detachably attached together; and in which the training unit includes a pair of upstanding frames mounted upon caster wheels so to be movable across the ground, the frames supporting several simulated player rusher's consisting of a fabric sheet stretched on a depending frame and the sheet having slits; and the target game unit consisting of netting pockets formed on a fabric sheet supported along its edges by tension springs from a tubular metal frame provided with means for being retained in an erect position while players toss a ball or the like into the pockets.

U.S. Pat. No. 5,252,076 relates to an apparatus for training athletes to reportedly improve their ability to concentrate on, track, and handle or catch a ball in motion with at least one central elongated body, a plurality of barrier arms for each elongated body with the barrier arms extending outward from and being arrayed along the central elongated body, and a mounting system for each central elongated body that is attached to and holds each central elongated body upright in substantially vertical position without the use of external supports. Barrier arms are made of flexible material.

U.S. Pat. No. 5,816,951 relates to a sports training device, which is a simulated human figure having at least one movable limb; a fluid-containing actuating system connected to the movable limb; and a trigger device connected to the fluid-containing actuating system, for activating the fluid-containing actuating system. The training device reportedly provides a distractive movement to acclimate the sports player to distractions.

U.S. Pat. No. 5,527,185 relates to an athletic training device comprising a base, an upright supported by the base, and a planar training shape simulative of a human athlete, including head, torso, arms and legs, mounted on said upright. The vertical height of the training shape is adjustable, and the arms articulate at the elbows and shoulders so that the position of the arms is adjustable. The training shape will remain at a predetermined height with the arms in a predetermined posture, so that the training device will represent an opponent at the posture and position for which the ball handler seeks to develop the countermove. Once the simulated opponent is countered at a first position and height, the height of the opponent can be raised.

SUMMARY OF THE INVENTION

A football training device is provided which is adapted to simulate a defensive line in order to acclimate a quarterback, kicker or other players to various characteristics of an opponent. The device is used to teach the quarterback, etc. how to maneuver a football over or around the figures of the device simulating the defensive line.

In one embodiment the device includes one or more figures connected to a base, with the figures individually adjustable in height, etc. In a further embodiment, the one or more figures are connected to a rotatable member operatively connected to the base. The figures are movable from a down, inactive position to an upright, active position which is adapted to mimic a defensive line formation after the football is snapped from center.

It is an object of the present invention to provide a sports training device which is relatively inexpensive, mechanically simple and lightweight which is readily affordable by most football teams including college and high school teams.

It is a further object of the present invention to provide a training device which improves a quarterback or kicker's timing and/or ability to maneuver a ball over or through holes in a defensive line.

It is also an object of the present invention to provide a training device which minimizes injuries occurred during practice.

It is a further object of the present invention to provide a training device that is easily moved from one location to another.

It is yet another object of the present invention to provide a training device which allows training drills to be performed in a repeatable manner.

The present invention achieves these and other objectives which will become apparent from the description that follows.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
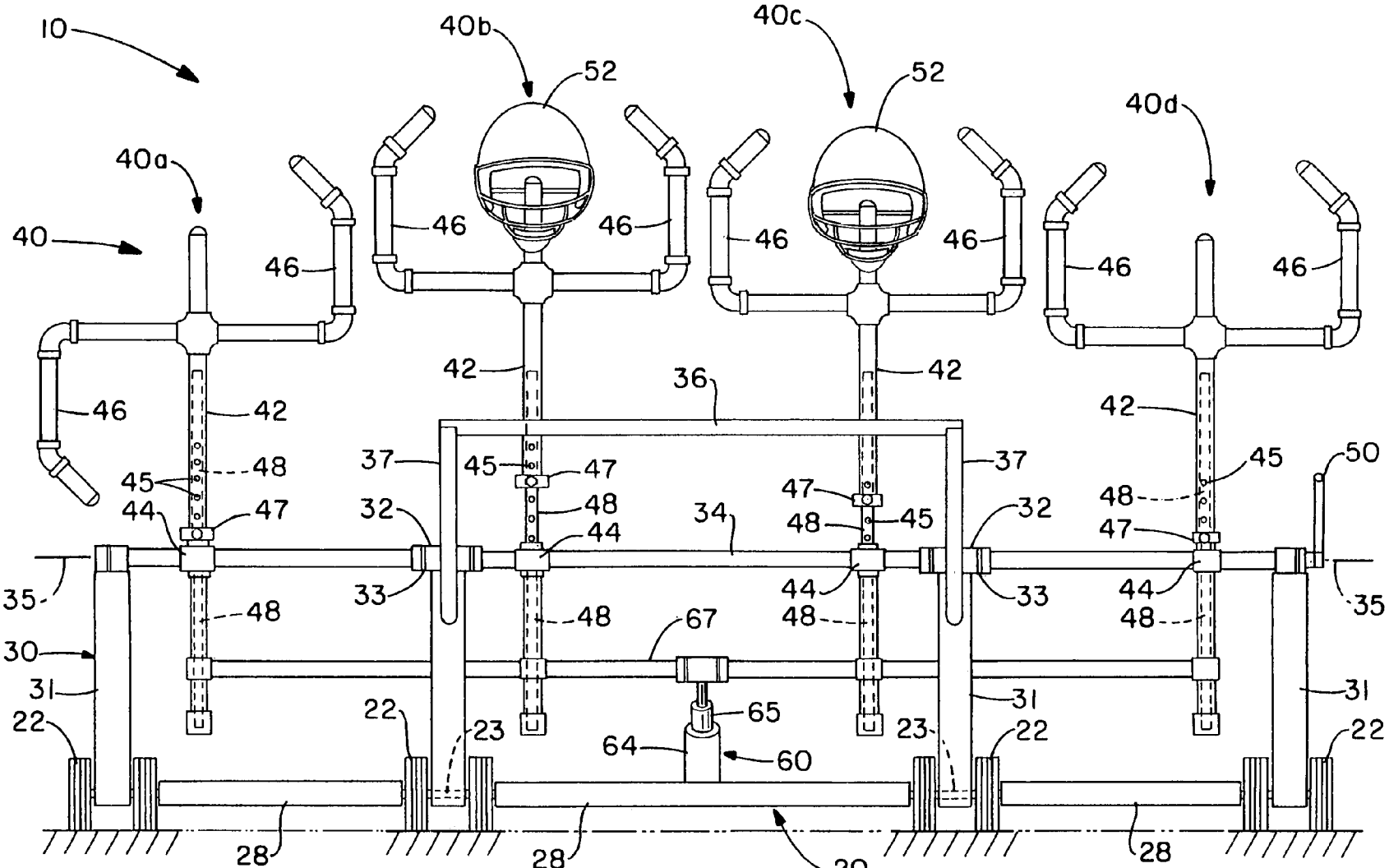
FIG. 1 is a front elevational view of one embodiment for a football training device in accordance with the present invention.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
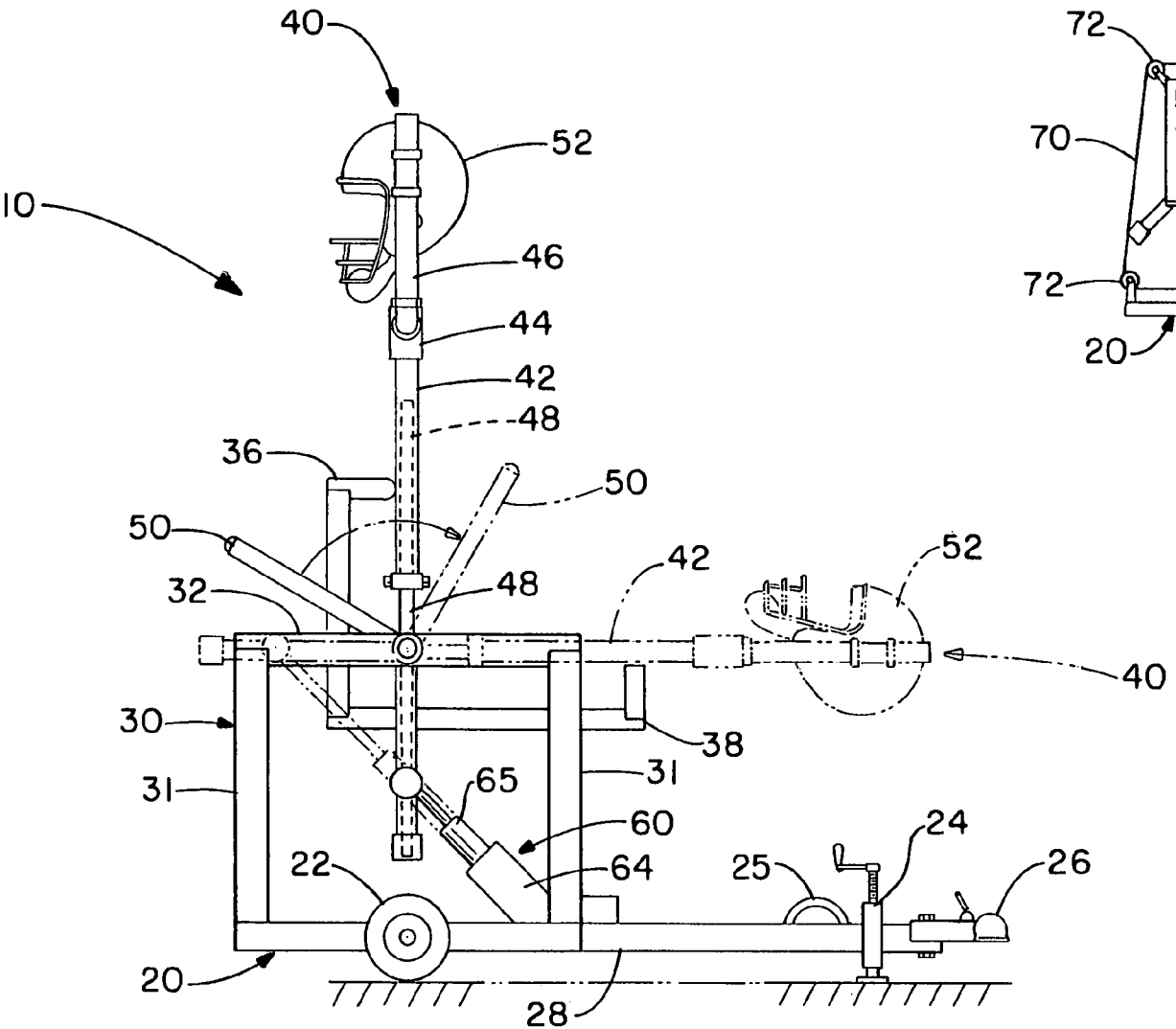
FIG. 2 is a right side elevational view of the device shown in FIG. 1 with a player figure shown in a raised height and upright active position, and also shown in a lower inactive position via ghost lines.
Figure 3:
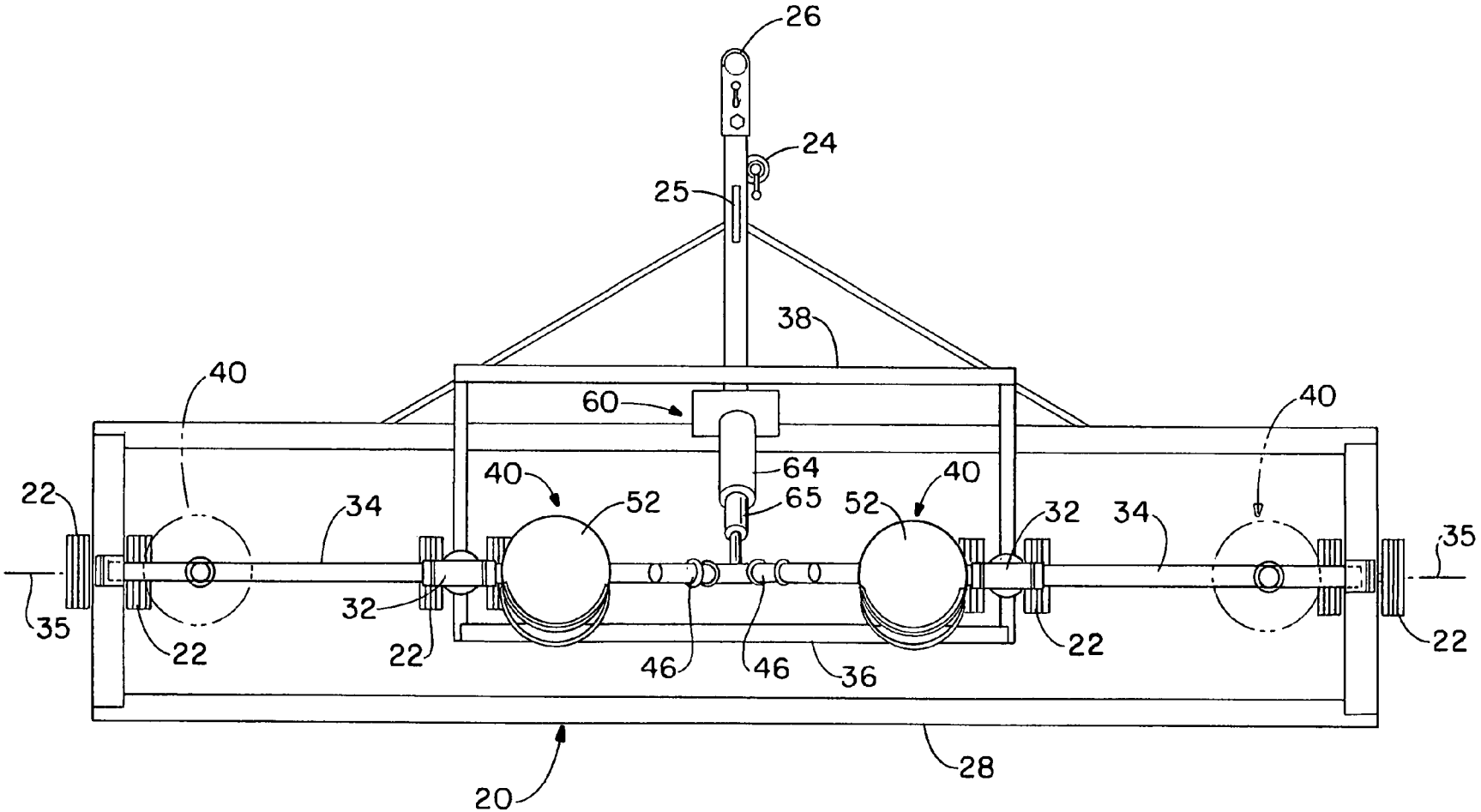
FIG. 3 is a top view of the device shown in FIG. 1 with portions broken away and other portions shown in ghost lines.

With reference now to the drawings, particularly FIGS. 1, 2, and 3, training device 10 includes base 20 which is adapted to contact a ground surface and provide stability to the remaining portions of the training device 10. Base 20 is constructed of one or more base beams 28 which are arranged and connected to provide a sturdy frame for the movable simulated human player figures 40. In one embodiment, base beams 28 or other structure or portion of the base is adapted to contact the ground. In a further embodiment, base 20 is provided with two or more wheels 22 rotatably journaled in axles 23 to provide rolling mobility to training device 10. FIG. 3 shows axles 23 operatively connected to beam 28 connected to one or more additional beams 28 or other fittings which collectively form a box-like frame. In many embodiments, the base 20 has an elongated structure in order to house, support and/or stabilize the plurality of simulated player figures 40 adapted to resemble a defensive line. In a preferred embodiment, from about 2 to about 10 wheels 22 and preferably six wheels 22 are operatively connected to the frame, preferably in pairs. Four pairs of wheels 22 are shown in at least FIG. 3. As illustrated in FIG. 2, in one embodiment hitch 26 is connected to base 20 in a suitable location such as at a rear end, so that the training device can be trailered by a car, truck, golf cart, or other towing vehicle. The training device 10 is relatively light in weight and can even be moved by a person, such as with handle 25. In this manner, the training device 10 is easily moved to generally any desired area and positioned on a practice field or other location. A telescoping ground contacting member 24 is provided in a preferred embodiment. Ground contacting member 24 can include a jack which is utilized to raise or lower the rear portion of the training device in order to level the base 20. FIG. 3 illustrates a top view of a preferred embodiment for a base configuration of the training device 10 of the present invention. The rotatable figures 40 are situated on the frame so a weight balance, between the front and rear portions, of the frame is substantially attained.

Figure 4A:
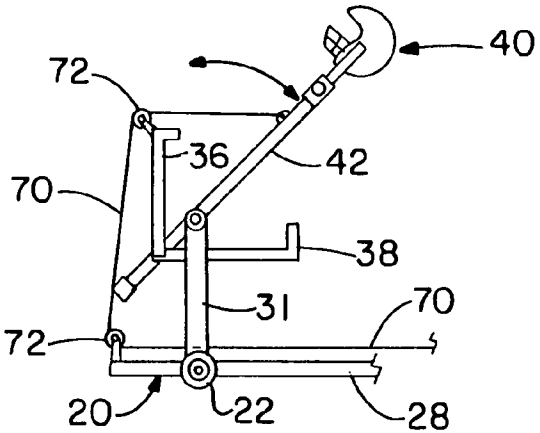
FIG. 4A–4B illustrates various activating mechanisms which may be applied to the device for moving player figures from an inactive lowered position to an active upright position.

Base 20 further includes one or more support members 30 connected to beam 28 or other structure of base 20. The support member 30 generally includes an upright substantially vertical section 31 and a cross section 32 connected to vertical section 31 in which rotatable member 34 is journaled and rotatable. Cross section 32 is generally substantially horizontally oriented. In a preferred embodiment, a vertical section is utilized to support each end of vertical section 31 as illustrated in FIG. 2 preferably through an appropriate fitting or connection. The support member 30 is substantially inverted "U" with the open ends of the "U" connected to base 20. In an alternative embodiment, the support member 30 is essentially straight with cross section 32 connected to the upper end of vertical section connected to base beams 28 as illustrated in FIG. 4A. A sufficient number of support members 30 are utilized so that figures 40 are adequately supported and allowed to perform their intended function, i.e., are free to rotate or move from a first position to at least a second position. Generally at least one support member 30 is used per figure 40 present in the device 10. The number of support members 30 generally ranges from 1 to about 20, desirably from about 2 to about 12, and preferably from about 6 to about 10 per device 10. FIG. 3 shows that a support member 30 is utilized on each side of simulated figure 40 to provide a strong, rigid frame. The extension or length of the support member in a vertical direction is sufficient so that the rotatable cross section 32 is located a predetermined distance from the bottom of base 20 or a ground surface. The support member 30 has a vertical length that ranges generally from about 6 to about 60 inches, desirably from about 8 to about 48 inches, and preferably from about 12 to about 36 inches.

Rotatable shaft member 34, rotatably journaled or operatively connected in the one or more support member 30 cross sections 32, is preferably substantially cylindrical with respect to the direction around the shaft axis of rotation 35, at least in the area of contact with cross section 32. When two or more support members 30 are utilized such as shown in FIGS. 1 and 3, the support member cross sections 32 have rotatable member housing portions which are aligned in relation to each other so that the axis of rotation 35 extends therethrough. Accordingly, rotatable member 34 extends a predetermined distance along axis of rotation 35. In some embodiments, bearings 33 are utilized to insure smooth rotation of rotatable member 34 in cross section 32.

As described hereinabove, one or more simulated human figures 40 are adjustably connected to rotatable member 34 in order to simulate the characteristics of an opposing line, preferably a defensive line. Four figures 40*a–d* are shown in FIG. 3. That said, the number of simulated figures 40 utilized in training device 10 ranges generally from about 1 to about 11, desirably from about 2 or 3 to about 9, and preferably from about 6 to about 8.

The rotatable member 34 is formed from one or more individual pieces fastened in some manner through a suitable fastener or fitting and has an overall length generally from about 3 to about 40 feet, desirably from about 6 to about 35 feet, and preferably from about 18 to about 30 feet in order to accommodate the predetermined number of figures 40. One or more figure connection members 44 are present on and connected to rotatable member 34 in order to attach figure 40 thereto. The figure connection members 44 are spaced a predetermined distance from each other in order to accommodate the figures 40 to be utilized in the training device 10. The distance between consecutive connection members 44 ranges generally from about 12 or about 24 to about 60 inches, desirably from about 36 to about 48 inches, and preferably about 44 inches.

Simulated human figure 40 includes a main body 42 operatively connected to inner tube or figure extension 48 having one or more and preferably a plurality of aperture(s) located thereon. F*igure* 40 is operatively connected to figure connection member 44 of rotatable member 34 through figure extension 48. Each main body 42 has a vertical length which ranges from about 12 to about 48 inches, desirably from about 18 to about 46 inches, and preferably from about 24 to about 42 inches. Main body 42 has a rotatable collar 47 connected to the lower end thereof which is connected to an aperture 45 of inner tube or figure extension 48. Figure extension 48 of figure 40 includes generally from about 1 to about 20 apertures, desirably from about 2 to about 15 apertures, and preferably from about 8 to about 12 apertures in order to provide a predetermined height to figure 40 in an up position as shown in FIG. 1. The apertures can be spaced from each other at increments of about 0.5, 1, 2, 3, 4 or 6 inches or the like. Tube 48 has a length generally from about 24 to about 60 inches, desirably from about 36 to about 56 inches, and preferably about 54 inches. Lower end of figure extension 48 rests against the lower portion of an extension figure connection member 44. F*igure* 40 in some embodiments also includes one or more arms 46 which are optionally movable from a down position to a raised position and are connected to main body 42, see FIG. 1. If desired, a football helmet can be attached to the upper portion of main body 42 utilizing any suitable fastener such as screws, nuts, bolts or the like. Each figure 40 individually has a greatest overall vertical height (i.e., top of helmet if present as in 40*b* and 40*c* of FIG. 1) measured from a ground surface or the bottom of base 20 of generally from about 4 feet to about 7 feet, desirably from about 5 feet to about 6 feet 10 inches, and preferably from about 5 feet 6 inches to about 6 feet 8 inches in an upright position as shown in FIG. 1. Thus, each figure 40 simulates a football player of a predetermined height. F*igure* 40 tube or figure extension 48 is connected to figure connection member 44 and a fastener is inserted through aperture 45 of spin collar 47 connected to main body 42 to operatively secure figure 40 to rotatable member 34. In a preferred embodiment, the spin collar is utilized so that figure 40 main body 42 can be turned or rotated on an axis perpendicular to rotational axis 35 while the collar 47 remains fixed to figure extension 48. In some embodiments collar 47 does not spin. The ability of the body 42 to turn or spin aids in absorbing shock or energy transferred to the figure when hit by a football. If desired, main body 42 of figure 40 can be directly connected to connection member 44 of rotatable member 34.

In one embodiment as illustrated in FIGS. 1–3, an activation mechanism 60 is utilized to move rotatable member 34 from a first position to a second position. A piston cylinder assembly or actuator is illustrated in at least FIGS. 1 and 3 having a first end operatively connected to base 20 such as through base beam 28 or a platform connected thereto and a second end operatively connected to rotatable member 34 in order to pivot figures 40 from a first position to at least a second position. In one embodiment, the piston cylinder is pneumatically or hydraulically operated. Numerous piston cylinder assemblies or actuators are known in the art and are commercially available from sources such as Norgren of Littleton, Colo. as the "Roundline" series, or Parker Hannifin of Des Plaines, Ill. as the SR series. As illustrated in FIG. 1, cylinder base 64 is connected to base member 28 and a moveable connecting rod 65 is connected to connecting bar 67 which is in turn connected to an extension of rotatable member 34, i.e., figure connection member 44. When the piston cylinder assembly is activated, the rotatable member is rotated about axis 35 thereby rotating any figures 40 connected thereto. If desired, a plurality of piston cylinder assemblies can be connected at various locations along the frame in order to rotate figures 40.

As illustrated in FIGS. 1 and 2, in an alternative embodiment the activating mechanism 60 is a lever 50 which is affixed to a suitable location on rotatable member 34 such as an end thereof. As illustrated in FIG. 2, the lever has a lower end connected to rotatable member 34 and is oriented at a predetermined angle with respect to horizontal and has a predetermined length to provide ease of use for a person manipulating the training device. With the figures 40 in a down position and substantially horizontal resting against stop 38, the lever is preferably situated at a predetermined angle with respect to horizontal as illustrated in FIG. 2. When the lever is rotated in a counterclockwise position, the rotatable member 34 is rotated and the figures 40 attached thereto are moved from a first position in this case, the down, inactive position to an up, active position which is substantially vertical, with a portion of the figure 40 resting against up position bumper 36. Figures 40 can be rotated with rotatable member 34 to a plurality of positions, preferably between down stop 38 and bumper 36, utilizing any activating mechanism. Of course, it is understood that stop 38 and bumper 36 may be omitted or modified in order to provide additional or less range of movement for figures 40.

Figure 4B:
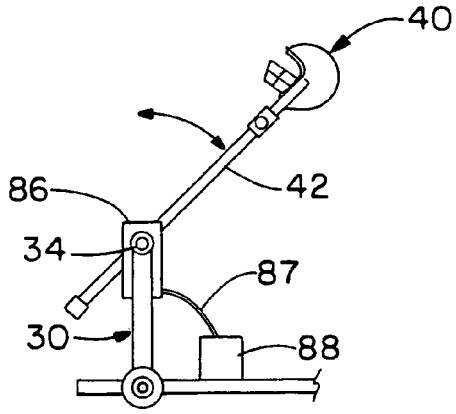
Figure 5:
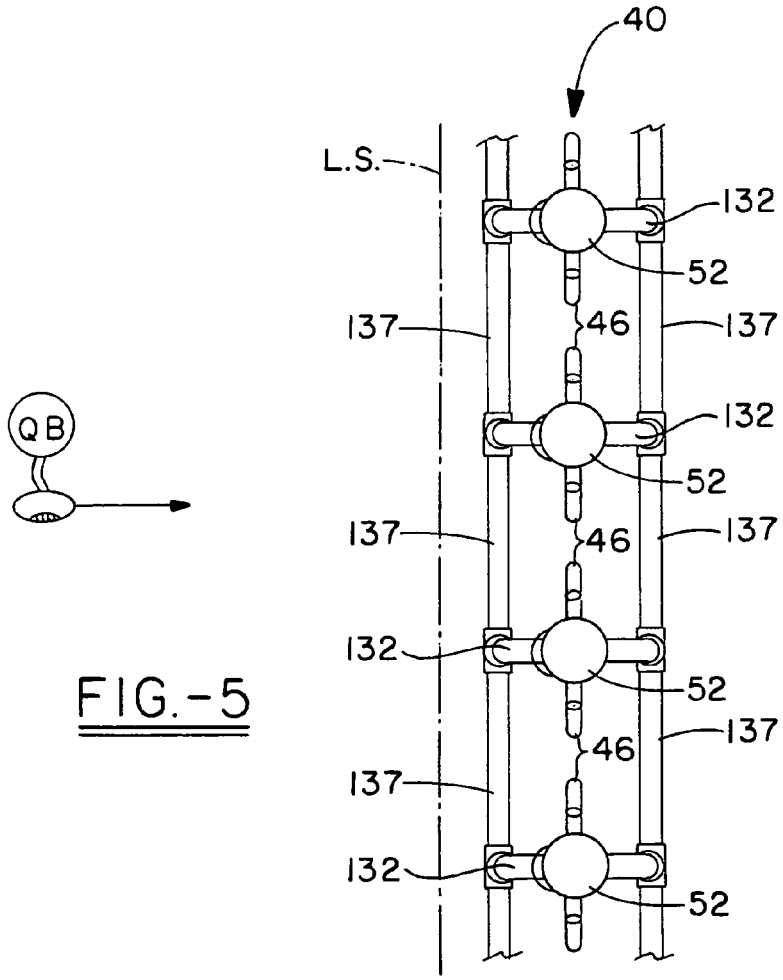
FIG. 5 illustrates the device of the invention, configured as in FIGS. 6 and 7, as it may be used in a football training exercise.

Additional activating mechanisms 60 are contemplated as shown in FIGS. 4A and 4B. FIG. 4A illustrates an alternative activating mechanism for the training device 10 of the present invention. As illustrated, cable 70 is attached to a figure main body 42 or other structure rotatably attached to rotatable member 34 and routed through one or more pulleys 72 connected to the training device 10 such as in location such as bumper 36 and along base beam 28 as illustrated in FIG. 4A. In order to raise figures 40, cable 70 is pulled so that figure 40 is rotated to an appropriate active position. A spring and trigger mechanism can also be utilized in conjunction with cable 70, wherein a trigger lock will maintain the figure in a down position until a trigger is activated whereby a spring force release rotates the figure 40 from a down to an up position.

FIG. 4B illustrates a further embodiment of a suitable activating mechanism utilized in the training device 10 of the present invention. Therein, servo 86 is fixedly connected to a bearing section 30 of the base other non-rotating structure of training device 10. Servo 86 has an operating portion connected to rotatable member 34 such as at end thereof as shown in FIG. 4B. Control apparatus 88 or electronic controller is connected to servo 86 by any suitable means such as wiring 87. Control apparatus or electronic controller 88 activates servo 86 which rotates rotatable member 34 and figure 40 attached thereto.

Figure 7:
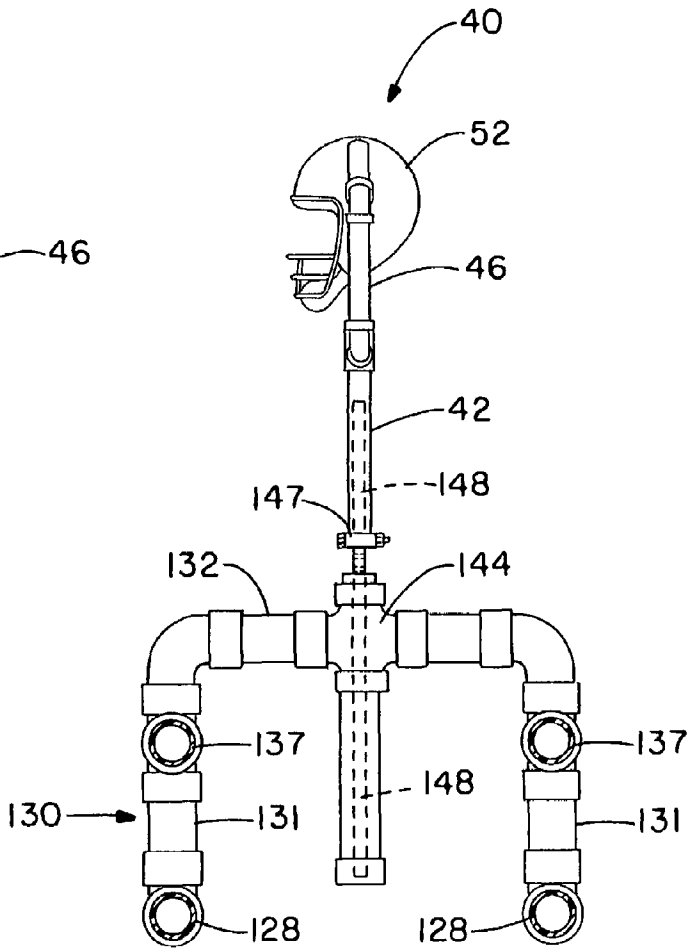
FIG. 7 is a cross sectional side view of the embodiment of FIG. 6 of the present invention wherein the figures are maintained in a stationary upright position.
Figure 6:
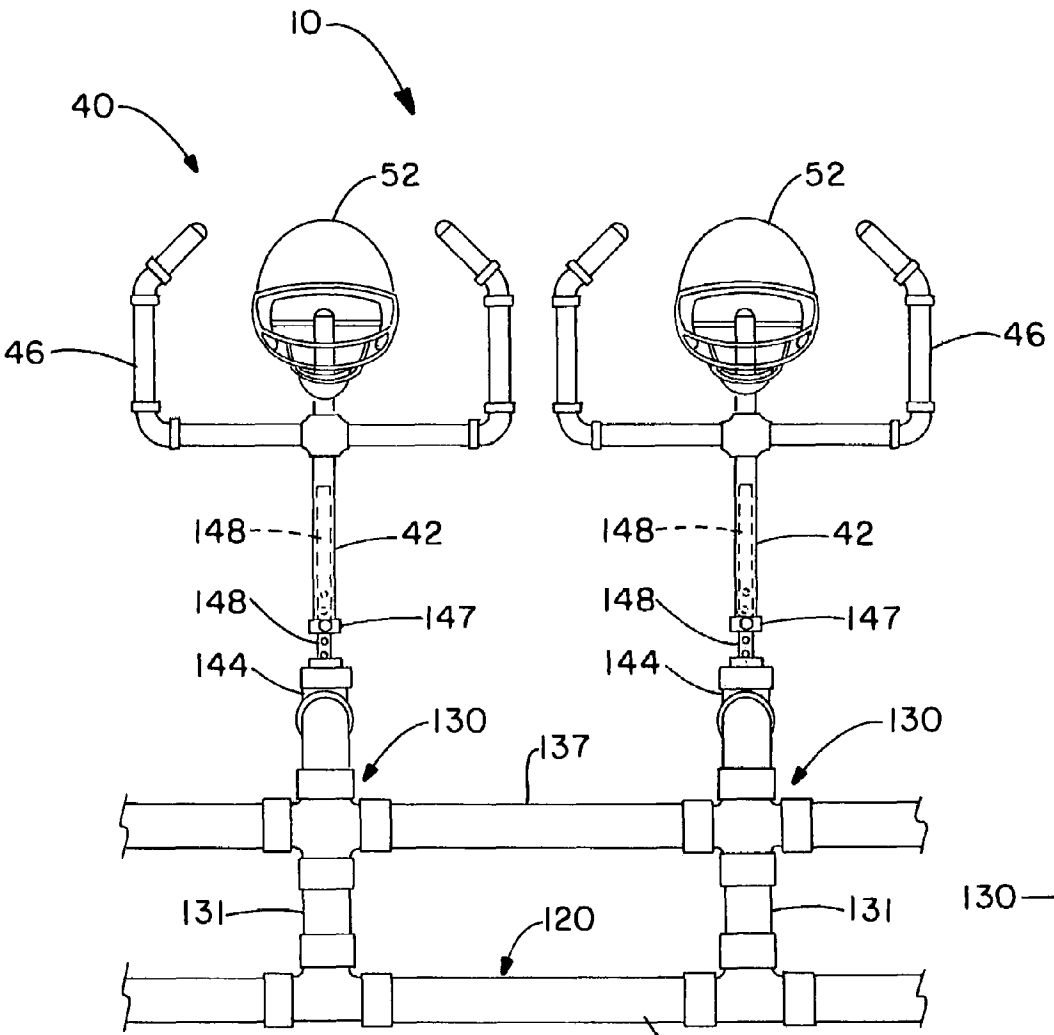
FIG. 6 is a partial front view of a further embodiment of the present invention wherein the figures are maintained in a stationary upright position.

In yet another embodiment of the present invention, training device 10 is provided with one or more, and preferably a plurality of figures 40 as described hereinabove and incorporated by reference which are fixed in a substantially upright position as illustrated in FIG. 6. The base 120 is formed substantially similar to the previously described embodiment and comprises base members 128 connected to one another to form a sturdy, rigid frame. If desired, the above-noted wheels can be connected to base members 128 through an axle or other suitable portion of base 120. One or more support members 130 of base 120 each have a substantially vertical section 131 in a substantially horizontal cross section 132 generally having a first end connected to a first vertical section 131 and a second end connected to a second vertical section 131 as illustrated in FIG. 7. As illustrated in FIGS. 6 and 7 frame rails 137 are utilized to connect one or more adjacent support members 130 to provide additional strength to device 10. Horizontal section 132 includes a figure connection section 144 to which figure 40 is operatively connected. FIG. 40 is preferably connected to figure connection section 144 through tube or figure extension 148. As described hereinabove, figure extension 148 includes a predetermined number of apertures to allow figure 40 to be connected at a plurality of different heights. Collar 147 has an aperture therein for allowing a portion of figure 40 to be connected to figure extension 148 and operatively connected to base 120. Collar 147 is preferably a spin collar which allows figure 40 to rotate in a clockwise or counterclockwise position when viewed from above. FIG. 40 is operatively connected to support member 130 of base 120, preferably as described hereinabove and incorporated by reference.

The training device 10 of the present invention can be constructed from generally any suitable materials including wood, metal, and plastic, or a combination thereof. In a preferred embodiment, the training device is constructed from a durable plastic material, either a thermoplastic or thermoset. In one embodiment, polyvinyl chloride or chlorinated polyvinyl chloride, or a combination thereof is utilized to form the base beams 28, support member 30, rotatable member 34, figure connection member 44, and at least portions of figures 40. In one embodiment, the base, rotatable member 34 and figures 40 are constructed utilizing schedule 40 or schedule 80 polyvinyl chloride or chlorinated polyvinyl chloride piping and fittings. In a further embodiment, the training device 10 is constructed from materials comprising PVC and/or aluminum, or combinations thereof.

In accordance with the patent statutes, the best mode and preferred embodiment have been set forth, the scope of the invention is not limited thereto, but rather by the scope of the attached claims.

What is claimed is:

1. A football training device, comprising:

a base of the football training device adapted to contact a ground surface, said base having one or more support members; wherein at least one figure connection member is connected to the one or more support members, wherein a figure extension is connected to one of the at least one figure connection member, and at least one figure adapted to simulate a human, wherein the figure extension has from 2 to about 20 apertures located at different vertical heights with each at least one figure operatively connected to one of said at least one figure connection member, and wherein the at least one figure has a main body extending in a substantially upright position, wherein the main body includes a collar that is connected to one of the apertures of the figure extension adapted to allow the at least one figure to be either fixed in relation to the base or to rotate in a direction around an axis parallel to a longitudinal axis of the figure extension, and wherein the at least one figure is height adjustable in relation to the base utilizing the apertures.

2. The device according to claim 1, wherein said one or more support members have a substantially vertical section and a substantially horizontal cross section, and wherein said at least one figure connection member is connected to said cross section, wherein the figure extension is linear and has a length of about 24 inches to about 60 inches.

3. The device accordint o claim 2, wherein 2 to about 11 figures are present and each operatively connected to a separate figure connection member.

4. The device according to claim 2, wherein each figure has an upper end adapted to be situated at a height above the bottom of the base of about 4 to about 7 feet.

5. The device according to claim 4, wherein at least two adjacent substantially vertical section support members are connected by a frame rail.

6. The device according to claim 1, wherein said figure main body collar is connected to said apertures to allow the figure main body to spin or rotate.

7. The device according to claim 6, wherein 4 to about 7 figures are present, wherein the upper end of each figure individually is adapted to have a height of about 5 feet to about 6 feet 8 inches, and wherein said base includes one or more base beams, said support members connected to said base beams.

8. The device according to claim 1, wherein said base further includes wheels, a hitch, a height adjustable jack, or a combination thereof, wherein the collar allows the main body to rotate, and wherein the figure extension is a tube having a length of from about 24 inches to about 60 inches.

9. A football training device, comprising:

a base having at least one support member connected thereto;

a rotatable member movably connected to said support member and rotatable about a substantially horizontal axis of rotation;

at least one figure adapted to simulate a human connected to a figure extention that is connected to figure connection member of the rotatable member, wherein the at least one figure is moveable around the axis of rotation, wherein the figure has main body that includes a collar that is connected to an aperture of the figure extension that allows the main body to be height adjustable on the figure extension in relation to the figure connection member; and an activating mechanism connected to and capable of manipulating the rotatable member and moving the at least one figure from a substantially horizontal position to at least a substantially vertical position, wherein each of the at least one figure connected to the rotatable member rotates around the horizontal axis of rotation when the activating mechanism manipulates the rotatable member.

10. The device according to claim 9, wherein about 1 to about 11 figures are each connected to a separate said figure connection member of the rotatable member, and wherein the rotatable member has a length of about 3 to about 40 feet.

11. The device according to claim 10, wherein 2 to about 11 figures are present, wherein each figure comprises a main body, and wherein each figure main body is located a distance of about 12 to about 60 inches from an adjacent figure main body.

12. The device according to claim 10, wherein the device includes an up position stop and a down position stop connected to the base or support member, and wherein the at least one figure is moveable to any position between the up position stop and down position stop.

13. The device according to claim 10, wherein about 2 to about 8 figures are connected to the rotatable member; and wherein the rotatable member has a length of about 18 to about 30 feet.

14. The device according to claim 10, wherein the activating mechanism is a lever, a hydraulic system, an electronic system, or a pulley assembly, or combinations thereof.

15. The device according to claim 10, wherein the base comprises wheels adapted to contact a ground surface, a hitch, or a height adjustable jack, or a combination thereof.

16. The device according to claim 15, wherein the at least one figure comprises a main body having at least one arm or a helmet or a combination thereof attached thereto, and wherein said main body collar is connected to the figure extension member so that the main body is rotatable around an axis perpendicular to the axis of rotation.

17. The device accordint to claim 10, wherein the figure extension has a plurality of apertures, said at least one figure having a main body operatively connected to said figure connection through one of said apertures.

18. The device according to claim 17, wherein said figure main body has a collar which is connected to said apertures to allow the figure main body to spin or rotate in relation to said base, and wherein 2 to about 20 apertures are present.

19. The device according to claim 11, wherein the device includes an up position stop and a down position stop connected to the base or support member, and wherein the at least one figure is movable to any position between the up position step and down position stop.

20. A football training device, comprising:

a base adapted to contact a ground surface, one or more support members connected to the base, wherein the one or more support members include two substantially vertical sections and a substantially horizontal cross section connected between the vertical sections, and wherein the cross section includes a figure connection section, wherein a figure extension is connected to the figure connection section, and a figure is operatively connected to the figure extension, and wherein the figure has a main body extending in a substantially upright position, wherein the main body includes a collar that is connected to an aperture of the figure extention adapted to allow the figure to be either fixed in relation to the base or to rotate in a direction around an axis parallel to a longitudibal axis of the figure extension, and wherein the figure extension is a tube that includes 2 to about 20 apertures that allow the figure to be connected to the figure extension at a plurality of different vertical heights.

21. The device according to claim 20, wherein the figure extension is linear and has a length of about 24 inches to about 60 inches.

22. The device according to claim 21, wherein one figure is present, and wherein the figure is rotatable in the direction around the axis parallel to the longitudinal axis of the figure extension.

23. The device according to claim 21, wherein the figure has an upper end adapted to be situated at a height above the bottom of base at about 4 to about 7 feet.

24. The device according to claim 23, wherein the base further includes at least two base members that form a frame, and wherein the two substantially vertical support member sections are connected to the base members.

25. The device according to claim 24, wherein one to about seven figures are present, and wherein each figure is connected to a separate cross section.

26. The device according to claim 25, wherein the base further includes wheels, a hitch, a high adjustable jack, or a combination thereof.

27. The device according to claim 19, wherein about 2 to about 8 figures are connected to the rotatable member, and wherein the rotatable member has a length of about 18 to about 30 feet.

28. The device according to claim 27, wherein the activating mechanism is a lever, a hydraulic system, an electronic system, or a pulley assembly, or combinations thereof.

* * * * *